United States Patent [19]

Vaughan

[11] 4,248,718

[45] Feb. 3, 1981

[54] OVERBASED LUBRICATING OIL ADDITIVE

[75] Inventor: Ronald J. Vaughan, Orinda, Calif.

[73] Assignee: Chevron Research Company, San Francisco, Calif.

[21] Appl. No.: 972,760

[22] Filed: Dec. 26, 1978

[51] Int. Cl.[3] ..... C10M 1/40; C10M 1/32; C10M 3/34; C10M 3/26

[52] U.S. Cl. ..... 252/33; 252/42.7; 252/51.5 A

[58] Field of Search ..... 252/33, 42.7, 51.5 A

[56] References Cited

U.S. PATENT DOCUMENTS

| | | | |
|---|---|---|---|
| 2,889,279 | 6/1959 | Carlyle et al. | 252/33 |
| 2,957,826 | 10/1960 | Martinek | 252/33.6 |
| 3,126,340 | 3/1964 | Sabol et al. | 252/33 |
| 3,320,162 | 5/1967 | Axe et al. | 252/33 |
| 3,429,811 | 2/1969 | Robbins et al. | 252/33 |
| 3,492,230 | 1/1970 | Watson et al. | 252/33 |
| 3,524,814 | 8/1970 | Sabol et al. | 252/33 |
| 3,535,242 | 10/1970 | Hashimoto et al. | 252/33 |
| 3,865,737 | 2/1975 | Kemp | 252/33 |
| 4,034,037 | 7/1977 | Jordan | 260/429 R |

*Primary Examiner*—Delbert E. Gantz
*Assistant Examiner*—Irving Vaughn
*Attorney, Agent, or Firm*—D. A. Newell; S. R. LaPaglia; V. J. Cavalieri

[57] ABSTRACT

A low-ash, high-alkalinity-value lubricating oil additive is prepared by chemically combining a nitrogen-containing compound, a basically reacting metallic compound, a suspending agent therefor, and a chalcogen compound.

16 Claims, No Drawings

OVERBASED LUBRICATING OIL ADDITIVE

FIELD OF THE INVENTION

This invention relates to a method for preparing overbased lubricating oil additives, to the additives themselves, and to lubricating oil compositions containing the additives.

With the increasing severity of operating conditions of the engines caused in part by the deteriorating quality of fuels for these engines, there is a need for compositions which can lubricate and maintain the cleanliness of the engine while, at the same time, neutralizing large quantities of acids which result from the use of fuels having an increased sulfur content. Conventional lubricating oil additives used to neutralize base contain ash-forming components, generally metallic salts. As increasing amounts of the acid-neutralizing components are used in formulations, the amount of ash in the composition often exceeds the amount of ash for which the engine is designed.

New additives are needed which can maintain the cleanliness of the engine and neutralize the large amounts of acid being formed from the increased use of high-sulfur fuel, while at the same time not exceeding the ash requirements of the engines being lubricated.

The preparation of conventional additives which are overbased to obtain additional acid-neutralizing efficiency is taught in U.S. Pat. No. 3,126,340. The additive described in this patent is prepared by treating a lubricating oil sulfonate dispersant with an alkaline earth metal oxide and hydroxide and then introducing carbon dioxide and ammonia into the mixture followed by heating the mixture in the presence of water to convert the ammonium carbamate formed from the carbon dioxide and ammonia to an alkaline earth metal carbonate. The alkaline earth metal carbonate is the acid-neutralizing portion of the composition.

U.S. Pat. No. 3,524,814 teaches the preparation of an overbased alkaline earth metal sulfonate by introducing a mixture of carbon dioxide and ammonia, in an amount sufficient to form a catalytic amount of ammonium carbamate, into a lubricating oil having in suspension a neutral alkaline earth metal sulfonate containing an alkaline earth oxide. After the catalytic amount of ammonium carbamate is preformed, carbon dioxide is continuously introduced into the reaction mixture until substantially all of the alkaline earth oxide is converted to alkaline earth metal carbonate. The metallic carbonate provides the reserve alkalinity in the sulfonate. As a post-treatment step, water is added to the reaction mixture. The addition of water decomposes any ammonium carbamate still present in the reaction mixture.

U.S. Pat. No. 4,034,037 teaches the production of metal carboxylates or N-organic substituted carbamates by reaction of a carboxylic acid or carbon dioxide with an amine in the presence of a soluble metal salt. These salts are disclosed to be useful as lubricating oil additives.

SUMMARY OF THE INVENTION

It has now been found that an overbased dispersant for lubricating oil compositions having a very low ash content as compared to conventional overbased additives can be prepared by combining in a solvent at a temperature suitable for reaction to occur the components (a) at least one ashless nitrogen-containing compound selected from ammonia, ammonium salts, and organic compounds containing only carbon, hydrogen, and nitrogen and having at least one —NH—group, (b) a basically reacting metallic compound, (c) at least one suspending agent for component (b), and (d) a chalcogen compound selected from carbon dioxide, carbon disulfide, carbon oxysulfide, or sulfur dioxide and mixtures thereof. To insure that the composition prepared by this reaction has a relatively low ash content, the ratio of the reactants (a), (b), (c), and (d) must be such that from about $\frac{1}{3}$ to about $\frac{3}{4}$ of the alkalinity value of the final product is derived from the ashless portion of these reactants.

DETAILED DESCRIPTION OF THE INVENTION

Component (a)—ashless nitrogen-containing compound

The nitrogen portion of component (a) serves as a source of supply of non-ash-forming basic material in the lubricating oil additives of this invention. By "ashless" is meant a substance which after combustion has no non-volatile residue. This ashless nitrogen-containing compound is ammonia, an ammonium salt, such as ammonium bicarbonate, ammonium acetate, or ammonium carbonate and the like, or an organic compound containing only carbon, hydrogen, and nitrogen atoms and having at least one —NH— group. Mixtures of different nitrogen-containing compounds may also be used. In general, the nitrogen compounds will be selected from the readily available aliphatic amines, polyamines, and ammonia.

Ashless nitrogen-containing compounds preferred for use in this reaction are ammonia, ammonium bicarbonate, aliphatic monoamines having up to 50 carbon atoms in the aliphatic portion of the molecule, and aliphatic polyamines such as methylenediamine, polymethylenepolyamines, ethyleneamines and propyleneamines. Aliphatic monoamines include methylamine, ethylamine, propylamine, octylamine, dicocoamine, decylamine, di(octyl)amine, tallowamine, eicosylamine, and the like. The amine may be derived from natural or synthetic sources using methods well known in the art. Preferred monoamines are $C_{1-20}$ alkylamines and particularly preferred are the $C_{1-4}$ alkylmonoamines, especially methylamine.

The polymethylenepolyamines are prepared from ammonia and formaldehyde and have a general repeating structure $H_2N(CH_2NH)_xH$ where x is 1–20. Preferred compounds are those where x is 1–6.

The ethyleneamines are those well known amines such as ethylenediamine, diethylenetriamine, triethylenetetraamine, tetraethylenepentamine, pentaethylenehexamine and the like which are usually prepared by the reaction of an alkylene dichloride and ammonia or from ethyleneimine and ammonia. This reaction yields a complex mixture of alkyleneamines including some cyclic condensation products. The products of this reaction are generally known in the art as ethyleneamines, as described above.

Propyleneamines are a class of polyamines prepared by the reaction of acrylonitrile with an ethyleneamine, such as those described above and having the formula $H_2N(CH_2CH_2NH)_xH$ where x is 1 to 5, followed by hydrogenation of the resultant intermediate. For example, the products prepared from ethylenediamine and acrylonitrile would be $H_2N(CH_2)_3NH(CH_2)_2NH(CH_2)_3NH_2$.

The most preferred amines for use in this invention are methylamine, ammonia and the ethyleneamines. The most preferred amine, from the standpoint of cost, is ammonia. The most preferred amine based on performance is ethylenediamine.

Component (b)—metallic compound

The basically reacting metallic compound component (b) is any metallic compound which reacts under basic conditions, i.e., at a pH greater than 7.0, to form a salt of an organic acid. Typical of such metallic compounds are calcium oxide, hydroxide or methoxide, magnesium oxide, hydroxide or methoxide, barium oxide or hydroxide, aluminum hydroxide, sodium hydroxide, lithium hydroxide, sodium alkoxide, and the like. Useful alkoxides are the lower-molecular-weight alkoxides such as methoxide, ethoxide, t-butoxide, and the like. Preferably the oxide or hydroxide of a Group II metal or a Group I metal hydroxide is used.

Preferred lubricating oil additives are prepared from magnesium, barium and calcium oxides or hydroxides, although sodium hydroxide is often desirable in certain applications. Most preferred for use in lubricating oil additives are those compositions prepared from a calcium-containing, basically reacting compound, especially calcium oxide and calcium hydroxide.

Component (c)—suspending agent

The suspending agent, component (c), which must be oil-soluble, is used to keep component (b), the basically reacting metallic component, in solution so that it can be an effective portion of the additive composition. Many of the useful suspending agents also have dispersant activity in the final lubricating oil additive composition. Typical suspending agents include alkali metal or alkaline earth metal hydrocarbylsulfonates, hydrocarbyl succinimides, hydrocarbyl succinates, hydrocarbyl succinic anhydrides, alkali metal or alkaline earth metal alkylphenates, alkylphenol-type Mannich bases and alkaline earth metal salts of such Mannich bases. Mixtures of suspending agents are also useful in carrying out the process of this invention.

The alkali metal and alkaline earth metal hydrocarbyl sulfonates useful in the process of this invention are well known in the art. The hydrocarbyl group must have a sufficient number of carbon atoms to render the sulfonate molecule oil soluble. Ordinarily, the hydrocarbyl portion has at least 20 carbon atoms and may be aromatic or aliphatic, but is usually alkylaromatic. Certain sulfonates are typically prepared by sulfonating a petroleum fraction having aromatic groups, usually mono- or dialkylbenzene groups, and then forming the metal salt of the sulfonic acid material. Other feedstocks used for preparing these sulfonates include synthetically alkylated benzenes and aliphatic hydrocarbons prepared by polymerizing a mono- or diolefin, for example, a polyisobutenyl group prepared by polymerizing isobutene. The metallic salts are formed directly or by metathesis using well-known procedures.

Succinimide dispersants are also well known in the art, and a general method for their preparation is found in U.S. Pat. Nos. 3,219,666, 3,172,892 and 3,272,746, the disclosures of which are hereby incorporated by reference. These compositions are prepared by reacting an oil-soluble alkyl or alkenyl succinic acid or anhydride with a nitrogen-containing compound. The succinimide may be of the type commonly known as a mono- or bis-succinimide. Preferred nitrogen compounds used in making the succinimides are those known as the ethyleneamines, and particularly preferred are triethylenetetraamine and tetraethylenepentamine. The preferred alkyl or alkenyl groups contain from 50 to 300 carbon atoms, and the most preferred compositions are prepared from polyisobutylene. When this type of suspending agent is employed, the amine portion will contribute to the alkalinity value.

The oil-soluble alkyl or alkenyl succinic anhydrides used in preparing the succinimides are themselves useful as suspending agents; however, they are most preferred for use as co-suspending agents, particularly in combination with a sulfonate suspending agent. Preferably the alkyl or alkenyl portion contains from 50 to 300 carbon atoms.

The succinate esters are prepared by reacting an alcohol with an alkenyl or alkyl succinic anhydride as described above, using a procedure such as that described in U.S. Pat. Nos. 3,381,022 and 3,522,179, the disclosures of which are hereby incorporated by reference. Ordinarily the alkyl or alkenyl group contains from 50 to 300 carbon atoms.

Alkali metal and alkaline earth metal phenates are well known in the art and are the alkali metal or alkaline earth metal salt of an oil-soluble alkyl-substituted phenol. The composition may be sulfurized. Typical phenates are prepared by neutralizing a $C_{8-128}$ alkylphenol with calcium hydroxide or oxide.

Mannich bases are useful suspending agents. Mannich bases are prepared by reacting an oil-soluble phenolic or alcoholic material, such as alkylphenol, with an aldehyde, such as formaldehyde or acetaldehyde, and a nitrogen-containing compound. Typical Mannich bases contain from about 8 to 128 or more carbon atoms in the alkyl group. If desired, the alkaline earth metal salt of the phenolic-type Mannich base may be used as a suspending agent.

Preparation

The reaction of this invention is carried out by adding a reactant selected from carbon dioxide, carbon disulfide, carbon oxysulfide or sulfur dioxide or mixtures thereof to the reaction mixture of components (a), (b), and (c). While the reactant is ordinarily added in the gaseous form, it may be added in liquid or solid form, for example, as dry ice or liquid sulfur dioxide. Carbon dioxide is the preferred reactant.

The reaction is carried out in a suitable solvent. Preferably the solvent is a lubricating oil so that no removal of the solvent is necessary before incorporation of the additive into the lubricating oil. Other useful solvents are lower-boiling hydrocarbon solvents such as hexanes or hydrocarbon thinner. Mixtures of lubricating oil with hexanes or hydrocarbon thinner are also very useful. After the preparation is complete, the lower-boiling hydrocarbon solvents are readily removed by heating, if desired.

Promoter

In an preferred embodiment of the invention a promoter is added. It probably functions as a solubilizing agent for the basically reacting metal compound and to keep any water formed during the reaction in solution. The promoter is preferably an alkanol of 1 to 6 carbon atoms or alkanediol of 2 to 6 carbon atoms such as methanol, ethanol, isopropanol, butanol, ethylene glycol, 1,4-butanediol and the like. Most preferred is ethanol.

Since the workability of the product is adversely affected by water, the process is preferably carried out under anhydrous conditions. If the basically reacting metal compound is one which generates water as a result of the reaction of this invention, sufficient promoter should be used to keep the water in solution. Water not in solution leads to gel formation and the irreversible formation of metal carbonate, which prevents efficient filtering.

The process of this invention may be carried out at any temperature from the freezing point of the mixture to its boiling point. Ordinarily the reaction is conducted at a temperature of from 0° to 75° C., preferably 20° to 75° C. and most preferably 25° to 50° C. However, when component (a) is ammonia, initial reaction temperatures as low as −10° C. are used. While the reaction proceeds satisfactorily at atmospheric pressure, higher or lower pressures may be used if desired.

The ratio of the suspending agent to the carbon dioxide and the nitrogen-containing material is such that from about $\frac{1}{3}$ to $\frac{3}{4}$ of the alkalinity value of the final composition is contributed to the ashless nitrogen-containing material. Preferably it is desirable to have about one equivalent of the nitrogen-containing compound for each equivalent of the basically reacting metallic compound. Under typical conditions and based on 1 equivalent of the basically reacting metallic compound, the reaction mixture would contain from 0.3 to 2.0, preferably from 0.5 to 1.5, equivalents of the nitrogen compound; from 1 to 3, preferably 1.5 to 2.5, equivalents of chalcogen compound; and from 2 to 20, preferably 4 to 10, parts by weight of the suspending agent per part of the basically reacting metallic compound. The hydrocarbon solvent should be present in sufficient amount to enable good mixing of the reactants and is usually present as from 5 to 50 and preferably 10 to 25 milliliters per gram of basically reacting metallic compound. From 0 to 5, preferably 1 to 2, milliliters of the promoter per gram of basically reacting metallic compound is also used.

In a preferred method for carrying out the reaction, a sodium, calcium or magnesium alkylbenzene sulfonate is used as the suspending agent. It is also preferred to use an alkenylsuccinimide or an alkenylsuccinic anhydride as a co-solubilizing agent. If this combination of solubilizing agents is used, an increased alkalinity value for the product is obtained when, prior to addition of component (a) the nitrogen compound, and the basically reacting material component (b), preferably an alkaline earth metal oxide or hydroxide, the mixture of components (b) and the solvent is pretreated with a small amount of component (d) for example with from 1 to 10%, preferably about 5%, of the total amount of component (d).

Compositions

The compositions prepared by this invention provide a high alkalinity value at a lower ash content than is present in most conventional dispersants and/or acid-neutralizers used as lubricating oil additives.

Alkalinity value is one method of specifying the degree of overbasing of the lubricating oil composition. It is also a measure of the acid-neutralizing properties of the composition. The method for determining the alkalinity value commonly used for a composition is set forth in ASTM Method D-2896. Briefly, the alkalinity value is the total base number given as milligrams of potassium hydroxide per gram of sample. It is the quantity of potassium hydroxide required to neutralize the same amount of perchloric acid that 1 gram of the sample neutralizes. For example, if a composition has the same acid-neutralizing capacity per gram as 10 mg of potassium hydroxide, the composition is given an alkalinity value of 10. The lower limit of alkalinity value is 0 for a neutral composition. Values of 200 or more are especially desirable for use in lubricants which are exposed to the decomposition products of sulfur-containing diesel fuels. Typical alkalinity values for additive compositions of this invention range from about 30 to 400 or more.

Lubricant compositions containing the additives of this invention are prepared by admixing through conventional admixing techniques the appropriate amount of the additive of this invention with a lubricating oil. The selection of a particular base oil depends on the contemplated application of the lubricant and on the presence of other additives. Generally, the amount of additive of this invention used in the lubricating oil will vary from 0.1 to 40% by weight, and preferably from 2 to 35% by weight. The resulting lubricating oil will usually have an alkalinity value in the range of 1 to 120, preferably 2.5 to 100.

The lubricating oil which may be used in this invention includes a wide variety of hydrocarbon oils such as naphthenic bases, paraffin bases and mixed-base oils. The lubricating oils may be used individually or in combination and generally have a viscosity which ranges from 50 to 5000 SUS (Saybolt Universal Seconds) and usually from 100 to 1500 SUS at 38° C.

In many instances it may be advantageous to form concentrates of the additives of this invention within a carrier liquid. These concentrates provide a convenient method of handling and transporting the additives of this invention before their subsequent dilution and use. The concentration of the additives of this invention within the concentrates may vary from 85 to 40% by weight, although it is preferred to maintain the concentration between about 50 and 70% by weight. The preferred method of obtaining concentrates is to carry out the preparation of the additive in a limited amount of lubricating oil, as will be used in making the final dilute lubricant composition. Alternatively, the additive may be prepared in a low-boiling hydrocarbon which is removed by distillation after adding a limited amount of lubricating oil.

As desired, other additives may be included in the lubricating oil compositions of this invention. These additives include antioxidants or oxidation inhibitors, dispersants, rust inhibitors, anticorrosive agents, and so forth. Other types of lubricating oil additives which may be employed include antifoam agents, stabilizers, antistain agents, tackiness agents, antichatter agents, dropping point improvers, antisquawk agents, extreme-pressure agents, odor control agents, and the like.

EXAMPLES

The following examples are presented to illustrate this invention, and are not in any way to be interpreted as limiting the scope of the invention.

EXAMPLE 1

To a 5-liter, 3-neck flask was charged 700 g of a 67% concentrate of a calcium alkylated aromatic sulfonate in hydrocarbon thinner, 350 g of a polyisobutenyl succinimide prepared from polyisobutenyl succinic anhydride having a number average molecular weight for the polyisobutenyl group of 1050, and tetraethylenepentamine as a 57% concentrate in lubricating oil and containing 2.13% nitrogen, 2100 ml of hydrocarbon thinner and 140 ml of 95% ethanol. The mixture was stirred at room temperature for 10 minutes and then 9 g of carbon dioxide was added over a 35-minute period at a temperature of from 25° to 28° C. Then 140 g of ethylenediamine and 180.5 g of calcium hydroxide were added to the mixture. An additional 206 g of carbon dioxide was added over a period of 2 hours, 17 minutes at a temperature of from 25° to 32° C. 50 g of diatomaceous earth was added to the mixture, which was then filtered through a pad of diatomaceous earth. The filtrate was stripped at 25 inches Hg vacuum. Then 250 g of neutral lubricating oil was added, and this product was stripped to 105° C. at 40 mm Hg pressure. The mixture yielded 1441 g of product having an alkalinity value of 329.4, and containing 6.21% calcium and 4.47% nitrogen.

EXAMPLE 2

To a 5-liter, 3-neck flask was added 440 g of the calcium sulfonate described in Example 1, 2000 ml of hydrocarbon thinner and 92 ml of methanol. This mixture was stirred and 73.2 g ethylenediamine and 68.4 g calcium oxide were added. To this mixture was added 101 g of carbon dioxide over a period of 1 hour, 4 minutes at a temperature of from 35° to 50° C. The product was stripped to 115° C. at atmospheric pressure and 250 ml of hydrocarbon thinner and 40 g of diatomaceous earth were added. The mixture was then filtered through filter aid and the filtrate was stripped after addition of 500 g of neutral lubricating oil to 100° C. at 20 mm of Hg pressure to yield 865 g of product as a 52% concentrate in oil having an alkalinity value of 184.6, containing 3.55% calcium and 2.43% nitrogen.

EXAMPLE 3

To a 1-liter, 3-neck flask was added 110 g of the calcium sulfonate described in Example 1, 200 ml of hydrocarbon thinner and 25 ml of methanol. This mixture was stirred and to it was added 18.3 g ethylenediamine and 17.1 g of calcium oxide. This mixture was heated to 50° C. and then 26 g of carbon dioxide was introduced over a period of 1 hour. The mixture was stripped to 75° C. at atmospheric pressure and then 5 ml water was added. The product set up into a gel. After addition of 15 ml of water, the gel broke. The mixture was heated to 75° C. and 10 g of diatomaceous earth was added. The mixture was filtered through diatomaceous earth and then stripped to 90° C. at 20 mm of Hg pressure to yield 63 g of product having an alkalinity value 404.3 and containing 4.76% nitrogen and 28.54, 28.75% sulfated ash.

EXAMPLE 4

To a 2-liter, 3-neck flask was added 184 g of the calcium sulfonate described in Example 1, 420 ml of hydrocarbon thinner and 23 ml of methanol. This mixture was stirred and to it was added 9.3 g of ethylenediamine and 33.9 g of calcium hydroxide. The mixture was heated to 45° C. and then 29 g of carbon dioxide was added at a temperature of 45°–48° C. The product was stripped to 132° C. under atmospheric pressure. The product was then filtered through diatomaceous earth and was stripped to 160° C. at atmospheric pressure and then to 204° C. at 20 mm Hg pressure to yield 133 g of product having an alkalinity value of 275.1, a sulfated ash of 29.5% and containing 1.7% nitrogen.

EXAMPLE 5

To a 5-liter, 3-neck flask was added 700 g of the calcium sulfonate described in Example 1, 350 g of the succinimide described in Example 1, 2100 ml of hydrocarbon thinner and 140 ml of 95% ethanol. The reaction mixture was stirred at room temperature for 10 minutes and then 6 g of carbon dioxide was added at 25° C. over a 28-minute period. To the mixture was then added 140 g of ethylenediamine and 180.5 g of calcium hydroxide. To this mixture was added 203 g of carbon dioxide over a period of 2 hours, 20 minutes at a temperature of 32° C. The product was stripped to 110° C. and 50 g of diatomaceous earth was added. The product was filtered through diatomaceous earth and then 250 g of 100 neutral lubricating oil was added and the mixture was stripped to 110° C. at 20 mm Hg pressure to yield 1316 g of product having an alkalinity value of 299.5 and containing 3.7% nitrogen and 6.54% calcium. The alkalinity value as measured by ASTM Method D-664 was 327.

EXAMPLE 6

To a 5-liter, 3-neck flask was added 440 g of the calcium sulfonate described in Example 1, 2000 ml of hydrocarbon thinner and 150 ml of isopropyl alcohol. This mixture was stirred and to it was added 73.2 g ethylenediamine and 68.4 g of calcium oxide. Then, 99 g of carbon dioxide was introduced at a temperature of from 35° to 47° C. over a period of 1 hour, 18 minutes. The product was then stripped to 115° C. (bottoms) and 60 g of diatomaceous earth was added. The mixture was stirred for 20 minutes while cooling and then filtered through diatomaceous earth. The filtrate was treated with 40 g diatomaceous earth and filtered again through diatomaceous earth. To the filtrate was added 400 g of 100 neutral lubricating oil and the mixture was stripped to 95° C. at 20 mm Hg pressure to yield 819 g of product as a 49% concentrate in oil and having an alkalinity value of 207, and containing 3.66% calcium and 2.89% nitrogen.

EXAMPLE 7

To a 5-liter, 3-neck flask was added 560 g of the calcium sulfonate described in Example 1, 280 g of polyisobutenyl succinic anhydride wherein the polyisobutenyl group had a number average molecular weight of 1050, 140 g ethylenediamine and 2100 ml of hydrocarbon thinner. The mixture was stirred for 15 minutes at room temperature and then 140 ml of ethanol and 169 g of calcium hydroxide were added. To this mixture, 188 g of carbon dioxide was introduced at a temperature of from 25° to 38° C. over a period of 2 hours, 12 minutes. The mixture was then stripped to 150° C. and 50 g of diatomaceous earth was added. The mixture was cooled with stirring to 40° C. and then filtered through diatomaceous earth. The product was stripped to 110° C. at 40 mm Hg pressure to yield 938 g of product having an alkalinity value of 374.3 and containing 4.20% nitrogen and 27.34% sulfated ash. The alkalinity value by ASTM Method D-664 was 407.

EXAMPLE 8

To a 1-liter, 3-neck flask was added 150 g of the calcium sulfonate described in Example 1, 30 g of the succinimide described in Example 1, 350 ml of hydrocarbon thinner, 25 ml of 95% ethanol and 22.6 g of calcium hydroxide. The reaction mixture was cooled to 5° C.

and 20 g of monomethylamine was added. A dry-ice condenser was placed on the reaction flask to avoid loss of methylamine during the addition. The reaction system was sparged with nitrogen before beginning carbonation and then 26 g of carbon dioxide was added at a temperature of 17° to 25° C. over a period of 5 minutes. The product was centrifuged for 1 hour at 11,000 revolutions per minute. The solids from centrifugation were isolated by washing with mixed hexanes, centrifuging and drying in a vacuum oven. The alkalinity value of the solids was 1008.4.

EXAMPLE 9

To a 1-liter, 3-neck flask was added 90 g of sodium sulfonate prepared by sulfonating 60 weight percent of petroleum fraction and 40 weight percent of a synthetic alkylbenzene, 300 ml hydrocarbon thinner, 15 ml of 100% ethanol, 9.2 g of 98% ethylenediamine and 12.0 g of sodium hydroxide. To the reaction mixture was added 13 g of carbon dioxide at a temperature from 25° to 30° C. over a period of 1 hour, 6 minutes. The mixture was stripped to 115° C. (bottoms), cooled to room temperature and then 15 g of diatomaceous earth added. The mixture was filtered through diatomaceous earth and the filtrate was then stripped to 110° C. at 15 mm Hg pressure to yield 82 g of product having an alkalinity value of 30.6 and containing 2.87% sodium and 0.28% nitrogen.

EXAMPLE 10

To a 5-liter, 3-neck flask was added 880 g of the calcium sulfonate described in Example 1, 2000 ml of hydrocarbon thinner, 140 ml of 95% ethanol, 140 g of 98% ethylenediamine and 118.5 g of aluminum hydroxide. To this mixture was added 101 g of carbon dioxide at a temperature of from 25° to 35° C. over a period of 1 hour, 15 minutes after which 84 g of calcium hydroxide was added. The mixture was stripped to 115° C. and the product centrifuged at 11,000 rpm for 30 minutes. The mixture was filtered through diatomaceous earth and the filtrate stripped to 115° C. at 20 mm Hg pressure to yield 579 g of product having a alkalinity value of 61.7 and containing 0.0002% aluminum, 0.1361% calcium and 1.88% nitrogen.

EXAMPLE 11

To 1 1-liter, 3-neck flask was added 1918 g sodium bicarbonate, 5 ml water, 20 ml methanol, 10.3 g magnesium oxide, 170 g of the sulfonate described in Example 1, and 400 ml of hydrocarbon thinner. This mixture was stirred and to it was added 15.3 g of ethylenediamine. To this mixture at a temperature of 30°-35° C. was added 23 g carbon dioxide over a period of 3 hours. The mixture was then stripped to 115° C. (bottoms). Diatomaceous earth was added to the product which was then filtered, centrifuged for 0.5 hour at 11,000 RPM, and filtered again through diatomaceous earth. The filtrate was stripped to 115°-120° C. at 4 mm Hg pressure to yield 159 g of product having an alkalinity value of 208.

EXAMPLE 12

To a 2-liter, 3-neck flask was added 120 g of the calcium sulfonate described in in Example 1, 600 ml of hydrocarbon thinner, 50 ml of ethanol, 80 g of the succinimide described in Example 1 and 22.6 g of calcium hydroxide. The reaction mixture was cooled to −5° C. Ammonia gas was introduced at a rate of 500 ml per minute for a period of 43 minutes. During the last 28 minutes of ammonia introduction, 28 g of carbon dioxide was simultaneously introduced. During the addition of the ammonia and the carbon dioxide, the temperature of the reaction mixture rose from −5° C. to 26° C. The reaction mixture was then stripped to 115° C. (bottoms) at atmospheric pressure, cooled to 25° C. and then 25 g of diatomaceous earth was added. The product was filtered through diatomaceous earth and the filtrate was stripped to 110° C. at 20 mm Hg pressure to yield 116 g of product having a alkalinity value of 144.8 and containing 4.82% calcium and 1.00% nitrogen.

EXAMPLE 13

A 3-liter, 3-neck flask as charged with 250 g of the calcium sulfonate used described in Example 1 and 600 ml of hydrocarbon thinner. This mixture was stirred while 50 ml liquid ammonia and 38 g carbon dioxide were introduced at room temperature. The reaction mixture was maintained at 25° C. throughout the reaction. To this mixture was added 40 ml methanol and 25.2 g calcium oxide. This mixture was stirred at room temperature, then heated to 45° C. and 100 ml methanol was added. The product was stripped to 130° (bottoms), centrifuged for 30 minutes at 11,000 rpm and then stripped to 95° C. at 20 mm Hg pressure to yield 147 g of product having an alkalinity value of 53.3 and containing 9.74% sulfated ash and 0.43% nitrogen.

EXAMPLE 14

To a 2-liter 3-neck flask was added 160 g of the calcium sulfonate described in Example 1 and 420 ml of hydrocarbon thinner. This mixture was stirred while 17 ml liquid ammonia and 28 g carbon dioxide were introduced at room temperature. The reaction mixture was maintained at 25° C. throughout the reaction. To this mixture was added 40 ml methanol and 25.2 g calcium oxide. The mixture was stirred at room temperature, then heated to 45° C. and 100 ml methanol was added. The product was stripped to 130° C. (bottoms), centrifuged for 30 minutes at 11,000 RPM and then stripped to 95° C. at 20 mm Hg pressure to yield 147 g of product having an alkalinity value of 185.3 and containing 6.9% calcium and 0.73% nitrogen.

EXAMPLE 15

To a 1-liter 3-neck flask was added 120 g of the calcium sulfonate described in in Example 1, 200 ml hexane and 25 ml methanol. The mixture was stirred and then 18.3 g ethylenediamine and 12.3 g magnesium oxide were added. The mixture was heated under reflux for 1 hour at 56°-58° C. Carbon dioxide was added at a flow rate of 100 ml/min and at a temperature of 53° C. over a period of 1 hour. The mixture was heated to reflux for ½ hour and then stripped to 75° C. at atmospheric pressure. 5 g of diatomaceous earth was added while cooling to 40° C., the mixture was filtered through diatomaceous earth and then stripped to 75° C. at 20 mm Hg pressure to yield 37 g of product having a alkalinity value of 101.6 and containing 0.0629% magnesium, 0.4050% calcium and 3.14% nitrogen.

EXAMPLE 16

To a 1-liter, 3-neck flask was added 90 g of sodium sulfonate as used in Example 9, 300 ml hydrocarbon thinner, 15 ml 100% ethanol, 9.2 g ethylenediamine, and 16.2 g sodium methoxide. Then, 8 g of carbon dioxide was added at a temperature of 30° C. over a period of 1 hour, 8 minutes. The mixture was stripped to 150° C. (bottoms); then it was cooled to 40° C. and 10 diatomaceous earth was added. The mixture was centrifuged at 11,000 RPM for 30 minutes and then filtered through diatomaceous earth. The filtrate was stripped to 115° C. at 20 mm Hg pressure to yield 73 g of product having an alkalinity value of 153.3 and containing 6.6% sodium and 1.05% nitrogen.

EXAMPLE 17

To a 1-liter, 3-neck flask were added 90 g of sodium sulfonate as described in Example 9, 300 ml hydrocarbon thinner, 15 ml 100% ethanol, 9.2 g ethylenediamine and 12.0 g sodium hydroxide. Then, 13 g of carbon dioxide were added over a period of 1 hour, 44 minutes at a temperature of from 25°–30° C. The mixture was stripped to 115° C. (bottoms), cooled to room temperature and then 15 g of diatomaceous earth was added. The mixture was filtered through diatomaceous earth and then the filtrate was stripped to 110° C. at 15 mm Hg to yield 82 g of product having an alkalinity value of 30.6 and containing 0.28% nitrogen.

EXAMPLE 18

To a 5-liter, 3-neck flask was added 880 g of the calcium sulfonate described in Example 1, 280 g of the succinimide described in Example 1, 2100 ml hydrocarbon thinner and 140 ml ethanol. To this mixture was added 6 g of sulfur dioxide at room temperature over a period of 45 minutes. 140 g ethylenediamine and 180.5 g calcium hydroxide were added to the mixture, then 194 g carbon dioxide and 21 g of sulfur dioxide were added over a period of 2 hours, 20 minutes. The reaction mixture was then stripped to 110° C. (bottoms), centrifuged at 11,000 RPM for ½ hour and then filtered through diatomaceous earth and stripped to 110° C. at 20 mm Hg pressure. Then, 150 g of 100 neutral lubricating oil was added to yield 1035 g product having an alkalinity value of 234.3 and containing 1.26% sulfur, 2.78, 2.75% nitrogen, and 5.17% calcium.

EXAMPLE 19

To a 5-liter 3-neck flask was added 880 g of the calcium sulfonate described in Example 1, 280 g of succinimide described in Example 1, 2100 ml of hydrocarbon thinner and 140 ml of 95% ethanol. Over a period of 35 minutes, 3 g of sulfur dioxide and 4 g of carbon dioxide were added to the mixture. Then 140 g of ethylenediamine and 180.5 g calcium hydroxide were added and 186 g of carbon dioxide and 35 g of sulfur dioxide were added over a period of 2 hours, 50 minutes at a temperature from 30°–42° C. The reaction mixture was stripped to 115° C. (bottoms), centrifuged at 11,000 RPM for 30 minutes and then filtered through diatomaceous earth. The filtrate was stripped to 115° C. at 20 mm Hg pressure and 150 g of 100 neutral lubricating oil was added. The final product weighed 1288 g, had an alkalinity value of 318.3 and contained 2.10% sulfur, 6.81% calcium, and 3.75% nitrogen. The alkalinity value based on the ASTM D-664 titration was 342.

EXAMPLE 20

To a 5-liter, 3-neck flask was added 560 g of the calcium sulfonate described in Example 1, 280 g of the succinic anhydride described in Example 7, 140 g of ethylenediamine and 2100 ml of hydrocarbon thinner. The mixture stood for 15 minutes at room temperature after which 140 ml 95% ethanol and 169 g calcium hydroxide were added. Then, 183 g of carbon dioxide and 10 ml of carbon disulfide were added over a period of 2 hours, 25 minutes at a temperature of from 30°–35° C. The product was stripped to 115° C., filtered through diatomaceous earth and then stripped to 110° C. at 40 mm Hg pressure to yield a product having an alkalinity value of 352.6 and containing 4.41% nitrogen, 7.72% calcium and 1.53% sulfur.

EXAMPLE 21

To a 5-liter, 3-neck flask was added 600 g of the succinimide described in Example 1, 2500 ml hydrocarbon thinner and 150 ml 95% ethanol. The mixture was stirred and 110 g ethylenediamine and 158 g calcium hydroxide were added. 175 g of carbon dioxide was added over a period of 2 hours, 9 minutes at a temperature of from 30°–38° C. The mixture was stripped to 110° C. (bottoms), centrifuged at 11,000 RPM for 30 minutes and then filtered through diatomaceous earth. The filtrate was treated with 50 g of diatomaceous earth and stripped to 105° C. at 20 mm Hg pressure to yield 647 g of product having an alkalinity value of 385.3 and containing 5.58% nitrogen and 23.19% sulfated ash.

EXAMPLE 22

To a 2-liter, 3-neck flask was added 200 g of the succinic anhydride described in Example 9, dissolved in 1000 ml of hydrocarbon thinner and 43.6 g of ethylenediamine. The mixture was heated to 100° C. and then cooled to room temperature and 48.5 g of calcium hydroxide and 50 ml of 95% ethanol were added. Then, 40 g of carbon dioxide was added over a period of 41 minutes at a temperature of from 30° to 45° C. The mixture was then stripped to 115° C. (bottoms) and filtered through diatomaceous earth. The filtrate was stripped to 105° C. at 20 mm Hg pressure to yield 214 g of product having an alkalinity value of 344.1 and containing 4.85% nitrogen and 6.76% calcium.

EXAMPLE 23

To a 2-liter, 3-neck flask was added 36 g of the succinic anhydride described in Example 9, 18.4 g ethylenediamine and 500 ml hydrocarbon thinner. This mixture was heated to 50° C. for ½ hour. It was then cooled to room temperature and 110 g of the calcium sulfonate described in Example 1 were added along with 25 ml of ethanol and 22.2 g of calcium hydroxide. The mixture was stirred and then 45 g sulfur dioxide was added. An additional 200 ml of hydrocarbon thinner was added and the product was then stripped to 120° C. (bottoms). The product was centrifuged and a portion of the precipitate was taken up in hexanes and allowed to stand. This portion was then centrifuged at 18,000 rpm for 30 minutes. The product was dried in a vacuum desiccator. Upon analysis it contained 8.48% N and 37.0% sulfated ash.

EXAMPLE 24

To a 2-liter, 3-neck flask was added 250 g of the succinimide described in Example 1 and 1000 ml of hydrocarbon thinner. This mixture was stirred and then 50 ml of ethanol, 45.2 g of calcium hydroxide and 37 g ethylenediamine were added. This mixture was stirred at room temperature and then 50 g of carbon dioxide was added over a period of 1.2 hours. An additional 6 g of calcium hydroxide was added and another 3 g of carbon dioxide was introduced. The temperature of the reaction mixture rose to 42° C. during the addition of the carbon dioxide. The mixture was stripped to 115° C. (bottoms). The product was centrifuged at 11,000 RPM for ½ hour, then filtered twice through diatomaceous earth and stripped to 105° C. (bottoms) at 20 mm Hg pressure to yield 299 g of product having an alkalinity value of 297.1 and containing 5.22% calcium and 4.69, 4.73% nitrogen.

EXAMPLE 25

The compositions of the Examples noted in Table I were tested in a Caterpillar 1-G-2 test in which a single-cylinder diesel engine having a 5⅛" bore by 6½" stroke is operated under the following conditions: timing, degrees BTDC, 8; brake mean effective pressure, psi 141; brake horsepower 42; Btu's per minute 5850; speed 1800 RPM; air boost, 53" Hg absolute; air temperature in, 225° F.; water temperature out, 190° F.; and sulfur in fuel 0.4%w. At the end of each 12 hours of operation, sufficient oil is drained from the crankcase to allow addition of 1 quart of new oil. In the test on the lubricating oil compositions of this invention, the 1-G test is run for 60 hours. At the end of the 60-hour period, the engine is dismantled and rated for cleanliness using the Institute of Petroleum Test Number 247/69 merit rating system for engine wear and cleanliness, accepted by ASTM, API and SAE as a rating system for engines. The over-all cleanliness of the engine is noted as WTD, which is the summation of the above numbers. Lower values represent cleaner engines.

The base oil used in these tests is a Citcon 350 neutral oil containing the noted amount of additive. Each oil was formulated to have an alkalinity value of 10.

TABLE I

| Ex. | Grooves | Lands | Under-head | WTD |
|---|---|---|---|---|
| 2 | 82.0-250.0-99.05-161.0 | 90.58-191.6-263.6 | 4.48 | 1137 |
| 7 | 83.0-250.0-318.5-182.0 | 105.0-413.5-250.3 | 12.18 | 1602 |
| 21 | 66.0-238.8-90.1-44.1 | 110.5-178.5-218.8 | 10.18 | 947 |

What is claimed is:

1. A process for the preparation of a lubricating oil additive composition consisting essentially of combining in a solvent at a temperature suitable for reaction to occur:

(a) at least one ashless nitrogen-containing compound selected from the class consisting of ammonia, ammonium salts, and organic compounds containing only carbon, hydrogen, and nitrogen and having at least one —NH—group, (b) a basically reacting metallic compound, (c) at least one suspending agent for component (b), and (d) a chalcogen compound selected from carbon dioxide, carbon disulfide, carbon oxysulfide and sulfur dioxide, and mixtures thereof, the ratio of the reactants (a), (b), (c) and (d) being such that from about ⅓ to about ¾ of the alkalinity value of the additive composition is derived from the ashless portion of said composition and wherein per equivalent of the basically reacting metallic compound, the reaction mixture contains from 0.3 to 2.0 equivalents of the nitrogen compound, from 1 to 3 equivalents of the chalcogen compound and from 2 to 20 parts per weight of the suspending agent per part of the basically reacting metallic compound.

2. The process according to claim 1 wherein component (a) is an aliphatic monoamine, an aliphatic polyamine, ammonia, or ammonium bicarbonate, and component (c) is an alkali metal or alkaline earth metal hydrocarbylsulfonate, a hydrocarbylsuccinimide, a hydrocarbylsuccinate, a hydrocarbylsuccinic anhydride, an alkali metal or alkaline earth metal alkylphenate, a Mannich base or an alkaline earth metal salt of a Mannich base, or mixtures thereof.

3. The process according to claim 2 wherein component (b) is a Group I metal hydroxide or Group II metal oxide or hydroxide.

4. The process according to claim 3 wherein component (c) is an alkali metal or alkaline earth metal hydrocarbylsulfonate, a hydrocarbylsuccinimide or a hydrocarbylsuccinic anhydride, or mixtures thereof.

5. The process according to claim 4 wherein component (a) is ammonia, a $C_{1-50}$ aliphatic monoamine, methylenediamine, polymethylenepolyamine, an ethyleneamine or a propyleneamine, component (d) is carbon dioxide, and the reaction is carried out in the presence of a promoter which keeps any water present in solution.

6. The process according to claim 5 wherein component (b) is an oxide or hydroxide of barium, calcium or magnesium and said promoter is a $C_{1-6}$ alkanol or a $C_{2-6}$ alkanediol.

7. The process according to claim 6 wherein component (c) is an alkali metal or alkaline earth metal hydrocarbylsulfonate in combination with an alkyl or alkenyl succinimide or an alkyl or alkenyl succinic anhydride, each of said alkyl or alkenyl groups containing from 50 to 300 carbon atoms.

8. The process according to claim 7 wherein component (b) is calcium oxide or calcium hydroxide and said promoter is ethanol.

9. The process according to claim 8 wherein component (a) is ammonia, methylamine or ethylenediamine.

10. The process according to claim 7, 8 or 9 wherein component (c) and said promoter are combined with a portion of the carbon dioxide prior to the addition of components (a) and (b) and the remainder of the carbon dioxide.

11. The product prepared by the process of claim 1, 2, 3, 4, 5, 6, 7, 8 or 9.

12. The product prepared by the process of claim 10.

13. A lubricating oil composition comprising an oil of lubricating viscosity and from 0.1 to 40% by weight of a product according to claim 11.

14. A lubricating oil composition comprising an oil of lubricating viscosity and from 0.1 to 40% by weight of a product according to claim 12.

15. A lubricating oil concentrate which comprises from 10 to 60% by weight of an oil of lubricating viscosity and from 90 to 40% by weight of a product according to claim 11.

16. A lubricating oil concentrate which comprises from 10 to 60% by weight of an oil of lubricating viscosity and from 90 to 40% by weight of a product according to claim 12.

* * * * *